US009115715B2

(12) United States Patent
Tomioka et al.

(10) Patent No.: US 9,115,715 B2
(45) Date of Patent: Aug. 25, 2015

(54) COMPRESSOR WITH PRESSURE REDUCTION GROOVE FORMED IN ECCENTRIC PART

(71) Applicant: DAIKIN INDUSTRIES, LTD., Osaka-shi, Osaka (JP)

(72) Inventors: Naoto Tomioka, Kusatsu (JP); Takehiro Kanayama, Kusatsu (JP); Hiroki Kamiishida, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/348,047

(22) PCT Filed: Sep. 24, 2012

(86) PCT No.: PCT/JP2012/006065

§ 371 (c)(1),
(2) Date: Mar. 27, 2014

(87) PCT Pub. No.: WO2013/046632

PCT Pub. Date: Apr. 4, 2013

(65) Prior Publication Data

US 2014/0234147 A1 Aug. 21, 2014

(30) Foreign Application Priority Data

Sep. 28, 2011 (JP) ..... 2011-212206

(51) Int. Cl.
*F03C 2/00* (2006.01)
*F03C 4/00* (2006.01)
(Continued)

(52) U.S. Cl.
CPC ..... *F04C 18/22* (2013.01); *F04C 18/322* (2013.01); *F04C 29/023* (2013.01); *F04C 29/028* (2013.01); *F04C 23/001* (2013.01); *F04C 23/008* (2013.01); *F04C 2240/56* (2013.01)

(58) Field of Classification Search
USPC ..... 418/60, 63, 66, 76, 81, 91, 94, 11; 184/6.16–6.18
See application file for complete search history.

(56) References Cited

U.S. PATENT DOCUMENTS 4,704,076 A * 11/1987 Kawaguchi et al. ..... 418/94
5,374,171 A * 12/1994 Cooksey ..... 418/63
(Continued)

FOREIGN PATENT DOCUMENTS

CN 1934335 A 3/2007
JP 58-120897 U 8/1983
(Continued)

OTHER PUBLICATIONS

International Preliminary Report of corresponding PCT Application No. PCT/JP2012/006065, mailed on Dec. 25, 2012.
(Continued)

*Primary Examiner* — Theresa Trieu
(74) *Attorney, Agent, or Firm* — Global IP Counselors

(57) ABSTRACT

A rotary compressor includes a drive mechanism having a drive shaft with an eccentric part, and a compression mechanism. The compression mechanism includes a tubular cylinder covering an outer periphery of the eccentric part, a piston arranged inside the cylinder and fitted onto the eccentric part, an upper end plate closing an upper end of the cylinder, and a lower end plate closing a lower end of the cylinder. A lower end surface of the eccentric part defines a thrust bearing surface slidably contacting an upper end surface of the lower end plate. The drive shaft has an oil path with lubrication oil circulating through the oil path. The eccentric part has a circumferentially extending pressure reduction groove opening at part of the thrust bearing surface close to an inner circumferential side to reduce a pressure of the lubrication oil supplied from the oil path to the pressure reduction groove.

11 Claims, 9 Drawing Sheets

(51) Int. Cl.

| | |
|---|---|
| ***F04C 2/00*** | (2006.01) |
| ***F04C 18/00*** | (2006.01) |
| ***F04C 18/22*** | (2006.01) |
| ***F04C 29/02*** | (2006.01) |
| ***F04C 18/32*** | (2006.01) |
| *F04C 23/00* | (2006.01) |

(56) References Cited

U.S. PATENT DOCUMENTS

| | | | | |
|---|---|---|---|---|
| 6,537,045 | B2 * | 3/2003 | Riegger et al. | 418/63 |
| 2008/0274001 | A1 | 11/2008 | Okamoto et al. | |
| 2012/0141312 | A1 * | 6/2012 | Lee et al. | 418/66 |

FOREIGN PATENT DOCUMENTS

| | | | |
|---|---|---|---|
| JP | 3-70895 | A | 3/1991 |
| JP | 2000-283073 | A | 10/2000 |

OTHER PUBLICATIONS

International Search Report of corresponding PCT Application No. PCT/JP2012/006065, mailed on Dec. 25, 2012.

Chinese Office Action of corresponding Chinese Application No. 201280047307.6 dated Sep. 22, 2014.

* cited by examiner

COMPRESSOR WITH PRESSURE REDUCTION GROOVE FORMED IN ECCENTRIC PART

CROSS-REFERENCE TO RELATED APPLICATIONS

This U.S. National stage application claims priority under 35 U.S.C. §119(a) to Japanese Patent Application No. 2011-212206, filed in Japan on Sep. 28, 2011, the entire contents of which are hereby incorporated herein by reference.

TECHNICAL FIELD

The present disclosure relates to a rotary compressor, and particularly relates to measures for cooling of thrust bearing surfaces.

BACKGROUND ART

Conventionally, a rotary compressor has been known, which includes a cylinder, a piston disposed inside the cylinder and fitted onto an eccentric part of a drive shaft, and end plates closing the cylinder at ends thereof in an axial direction, and which is configured such that fluid is compressed by eccentric rotation of the piston in the cylinder (see, e.g., Japanese Unexamined Patent Publication No. H03-070895).

In the rotary compressor, a lower end surface of the eccentric part and an upper end surface of the lower end plate form a thrust bearing configured to receive a thrust load. Lubrication oil is supplied between the lower end surface of the eccentric part and the upper end surface of the lower end plate, i.e., between sliding surfaces of the thrust bearing, and cools the sliding surfaces of the thrust bearing to reduce abrasive wear of the sliding surfaces of the thrust bearing.

SUMMARY

Technical Problem

However, a large amount of gas refrigerant may be dissolved in lubrication oil flowing inside the drive shaft depending on operational conditions. If such lubrication oil is supplied between the sliding surfaces of the thrust bearing, bubbles of the gas refrigerant may be generated in the lubrication oil upon receipt of friction force. If gas is present between the sliding surfaces of the thrust bearing, there is a disadvantage that the sliding surfaces of the thrust bearing cannot be sufficiently cooled due to a lower thermal conductivity between gas and metal than a thermal conductivity between liquid and metal.

In recent years, due to limitation on installation location and an attempt to reduce the weight and cost of compressors, there is an increasing demand to further reduce the size of compact compressors used for, e.g., room-air conditioners. With this demand, the diameter of an eccentric part of a drive shaft has been reduced, and the area of a sliding surface of a thrust bearing has been reduced. Thus, tendency shows that the surface pressure of the sliding surface of the thrust bearing increases, and the amount of heat generation due to friction increases. For such a reason, there is a need to efficiently cool the sliding surfaces of the thrust bearing with lubrication oil.

The present disclosure has been made in view of the foregoing, and aims to enhance cooling of sliding surfaces of a thrust bearing with lubrication oil in a rotary compressor.

Solution to the Problem

A first aspect of the invention is intended for a rotary compressor including a drive mechanism (20) including a vertically-extending drive shaft (23) formed with an eccentric part (26); and a compression mechanism (30) including a tubular cylinder (34) covering an outer periphery of the eccentric part (26), a piston (50) arranged inside the cylinder (34) and fitted onto the eccentric part (26), an upper end plate (31) closing an upper end of the cylinder (34), and a lower end plate (35) closing a lower end of the cylinder (34). A lower end surface of the eccentric part (26) defines a thrust bearing surface (26*a*) slidably contacting an upper end surface (35*b*) of the lower end plate (35). An oil path (70) through which lubrication oil circulates is formed inside the drive shaft (23). A pressure reduction groove (65) opening at the thrust bearing surface (26*a*), extending in a circumferential direction, and configured to reduce a pressure of the lubrication oil supplied from the oil path (70) to the pressure reduction groove (65) is formed in the eccentric part (26).

In the first aspect of the invention, lubrication oil flowing through the oil path (70) of the drive shaft (23) is supplied to the pressure reduction groove (65) formed in the eccentric part (26). The lubrication oil supplied to the pressure reduction groove (65) is supplied between the thrust bearing surface (26*a*) of the eccentric part (26) and the upper end surface (35*b*) of the lower end plate (35) which slidably contact each other, and flows toward the outside in the radial direction by centrifugal force. Gas refrigerant is dissolved in the lubrication oil supplied from the oil path (70) to the pressure reduction groove (65), and the pressure of the lubrication oil is reduced in the pressure reduction groove (65). As a result, the gas refrigerant dissolved in the lubrication oil is separated, and bubbles of the gas refrigerant are generated in the lubrication oil. Since the lubrication oil has a specific gravity greater than that of the gas refrigerant, centrifugal force acting on the lubrication oil is greater than that acting on the gas refrigerant. Thus, when the gas refrigerant is separated from the lubrication oil in the pressure reduction groove (65), the gas refrigerant is accumulated in an upper part of the pressure reduction groove (65). Meanwhile, the lubrication oil having the specific gravity greater than that of the gas refrigerant receives great centrifugal force, and then flows out from the pressure reduction groove (65) toward the outside in the radial direction. Then, the lubrication oil is supplied between the thrust bearing surface (26*a*) and the upper end surface (35*b*) of the lower end plate (35). That is, since the lubrication oil from which the gas refrigerant is separated is supplied between the thrust bearing surface (26*a*) and the upper end surface (35*b*) of the lower end plate (35) which define sliding surfaces of a thrust bearing, bubbles of the gas refrigerant dissolved in the lubrication oil are not generated between the sliding surfaces of the thrust bearing.

A second aspect of the invention is intended for the rotary compressor of the first aspect of the invention, in which an oil groove (74) which extends in the circumferential direction and to which the lubrication oil is supplied from the oil path (70) is formed between the lower end plate (35) and the drive shaft (23), the pressure reduction groove (65) communicates with the oil groove (74) through a communication part (65*a*), and the communication part (65*a*) serves as a throttle configured to reduce a pressure of the lubrication oil supplied from the oil groove (74) to the pressure reduction groove (65).

In the second aspect of the invention, lubrication oil of the oil path (70) is supplied to the pressure reduction groove (65) through the oil groove (74) extending in the circumferential direction between the lower end plate (35) and the drive shaft (23). Since the communication part (65*a*) between the oil groove (74) and the pressure reduction groove (65) serves as the throttle, the pressure of the lubrication oil flowing into the pressure reduction groove (65) sharply decreases. As a result, gas refrigerant dissolved in the lubrication oil is separated, and bubbles of the gas refrigerant are generated in the lubrication oil.

A third aspect of the invention is intended for the rotary compressor of the first aspect of the invention, in which an oil groove (74) which extends in the circumferential direction and to which the lubrication oil is supplied from the oil path (70) is formed between the lower end plate (35) and the drive shaft (23), and the pressure reduction groove (65) and the oil groove (74) are configured such that a clearance (65*b*) formed between the thrust bearing surface (26*a*) and the upper end surface (35*b*) of the lower end plate (35) allows the pressure reduction groove (65) and the oil groove (74) to communicate with each other and the clearance (65*b*) serves as a throttle configured to reduce a pressure of the lubrication oil supplied from the oil groove (74) to the pressure reduction groove (65).

In the third aspect of the invention, lubrication oil of the oil path (70) is, after passing through the oil groove (74), supplied to the pressure reduction groove (65) through the clearance (65*b*) formed between the thrust bearing surface (26*a*) and the upper end surface (35*b*) of the lower end plate (35). Since the clearance (65*b*) serves as the throttle, the pressure of the lubrication oil flowing into the pressure reduction groove (65) sharply decreases. As a result, gas refrigerant dissolved in the lubrication oil is separated, and bubbles of the gas refrigerant are generated in the lubrication oil.

A fourth aspect of the invention is intended for the rotary compressor of the first or second aspect of the invention, in which, at the upper end surface (35*b*) of the lower end plate (35), a groove (61) extending in the circumferential direction and forming an elastic bearing (62) on an inner circumferential side is formed at periphery of a hole into which the drive shaft (23) is inserted, and the pressure reduction groove (65) is formed so as to overlap with the elastic bearing (62) as viewed in plane.

In the rotary compressor, the pressure of compressed fluid acts on the eccentric part (26) of the drive shaft (23) through the piston (50). Thus, there is a possibility that the drive shaft (23) greatly warps in, e.g., a high-load operation in which the internal pressure of a fluid compression chamber is relatively high. When the drive shaft (23) warps, so-called "corner scratching" occurs, i.e., a corner part formed between the upper end surface (35*b*) and an inner circumferential surface of the lower end plate (35) slidably contacts a main shaft part of the drive shaft (23). Upon the corner scratching, a contact surface pressure increases, and a sliding loss and abrasion at a thrust bearing part of the lower end plate increase. This results in lowering of an operation efficiency and reliability of the rotary compressor. In the present disclosure, the groove (61) forming the elastic bearing (62) on the inner circumferential side is, at the upper end surface (35*b*) of the lower end plate (35), formed at the periphery of the hole into which the drive shaft (23) is inserted, and the elastic bearing (62) elastically supports the drive shaft (23). Thus, an increase in contact surface pressure due to the corner scratching is reduced. However, although the elastic bearing (62) warps to elastically support the drive shaft (23), there is a possibility that part of an upper end of the elastic bearing (62) is caught by the thrust bearing surface (26*a*) of the eccentric part (26) upon warpage of the elastic bearing (62) and the thrust bearing surface (26*a*) is damaged.

In the fourth aspect of the invention, the pressure reduction groove (65) is formed so as to overlap with the elastic bearing (62) as viewed in the plane. Thus, even if the elastic bearing (62) is deformed, the upper end of the elastic bearing (62) enters the pressure reduction groove (65), and therefore is not caught by the thrust bearing surface (26*a*) of the eccentric part (26). Moreover, the elastic bearing (62) is formed in an inner circumferential part of the lower end plate (35). Thus, since the pressure reduction groove (65) is formed so as to overlap with the elastic bearing (62) as viewed in the plane, the pressure reduction groove (65) is formed at an inner circumferential end part of the thrust bearing surface (26*a*). The pressure reduction groove (65) formed at the inner circumferential end part of the thrust bearing surface (26*a*) allows lubrication oil flowing out from the pressure reduction groove (65) to extend across the entirety of the thrust bearing surface (26*a*).

A fifth aspect of the invention is intended for the rotary compressor of the fourth aspect of the invention, in which the pressure reduction groove (65) is formed such that an outer circumferential edge thereof is positioned on the inner circumferential side relative to an outer circumferential edge of the groove (61).

In the fifth aspect of the invention, the pressure reduction groove (65) is formed on the inner circumferential side relative to the outer circumferential edge of the groove (61). That is, the pressure reduction groove (65) is formed so as to have a diameter smaller than that of the groove (61) forming the elastic bearing (62). A larger diameter of the pressure reduction groove (65) opening at the thrust bearing surface (26*a*) results in a smaller area of the thrust bearing surface (26*a*). In the present disclosure, the pressure reduction groove (65) is formed so as to have the diameter smaller than that of the groove forming the elastic bearing (62). Thus, a decrease in area of the thrust bearing surface (26*a*) is reduced to the minimum possible.

A sixth aspect of the invention is intended for the rotary compressor of any one of the first to fifth aspects of the invention, in which a communication path (66) through which an upper part of the pressure reduction groove (65) and the oil path (70) communicate with each other is formed in the eccentric part (26).

In the sixth aspect of the invention, gas refrigerant separated from lubrication oil in the pressure reduction groove (65) is discharged to the oil path (70) through the communication path (66).

A seventh aspect of the invention is intended for the rotary compressor of any one of the first to sixth aspects of the invention, in which a side oil supply groove (72) through which the lubrication oil supplied from the oil path (70) to an upper side of the eccentric part (26) is guided to a lower side of the eccentric part (26) is formed at a side surface of the eccentric part (26), and the pressure reduction groove (65) is formed such that the side oil supply groove (72) opens to the pressure reduction groove (65) on a lower side of the side oil supply groove (72).

In the seventh aspect of the invention, the side oil supply groove (72) guiding lubrication oil from an upper end to a lower end of the eccentric part (26) is formed at a side surface of the eccentric part (26). That is, the side oil supply groove (72) extends from the upper end to the lower end at the side surface of the eccentric part (26). If the side oil supply groove (72) opens at the thrust bearing surface (26*a*), a corner part is formed between a wall surface forming the side oil supply groove (72) and the thrust bearing surface (26*a*), and there is a possibility that the corner part shaves off the upper end surface (35*b*) of the lower end plate (35) when the thrust bearing surface (26*a*) slides against the upper end surface (35*b*) of the lower end plate (35). In the present disclosure, the pressure reduction groove (65) is formed such that the side oil supply groove (72) opens to the pressure reduction groove (65) on the lower side of the side oil supply groove (72). Thus, even if the corner part is formed between the wall surface forming the side oil supply groove (72) and a wall surface forming an upper edge of the pressure reduction groove (65), the upper end surface (35*b*) of the lower end plate (35) is not shaved off by the corner part.

Advantages of the Invention

According to the first aspect of the invention, part of lubrication oil flowing through the oil path (70) of the drive shaft (23) is supplied to the pressure reduction groove (65) opening at the thrust bearing surface (26*a*), and the pressure of such lubrication oil is reduced. As a result, gas refrigerant dissolved in the lubrication oil is separated in the pressure reduction groove (65). Thus, only the lubrication oil receiving centrifugal force greater than that acting on the gas refrigerant can flow from the pressure reduction groove (65) toward the outside in the radial direction, and can be supplied to the space between the thrust bearing surface (26*a*) defining one of the sliding surfaces of the thrust bearing and the upper end surface (35*b*) of the lower end plate (35) defining the other sliding surface of the thrust bearing. Since generation of gas refrigerant between the sliding surfaces of the thrust bearing can be reduced, the sliding surfaces of the thrust bearing can be effectively cooled with lubrication oil, and abrasive wear can be reduced.

According to the second aspect of the invention, the oil groove (74) through which lubrication oil of the oil supply path (70) is guided to the pressure reduction groove (65) communicates with the pressure reduction groove (65) through the communication part (65*a*), and the communication part (65*a*) serves as the throttle configured to reduce the pressure of lubrication oil supplied from the oil groove (74) to the pressure reduction groove (65). Thus, with a simple configuration, the pressure of lubrication oil in which gas refrigerant is dissolved can be sharply decreased in the pressure reduction groove (65), and it can be ensured that the gas refrigerant is separated from the lubrication oil.

According to the third aspect of the invention, the oil groove (74) and the pressure reduction groove (65) are configured such that the oil groove (74) through which lubrication oil of the oil supply path (70) is guided to the pressure reduction groove (65) communicates with the pressure reduction groove (65) through the clearance (65*b*) formed between the thrust bearing surface (26*a*) and the upper end surface (35*b*) of the lower end plate (35), and that the clearance (65*b*) serves as the throttle configured to reduce the pressure of lubrication oil supplied from the oil groove (74) to the pressure reduction groove (65). Thus, with a simple configuration, the pressure of lubrication oil in which gas refrigerant is dissolved can be sharply decreased in the pressure reduction groove (65), and it can be ensured that the gas refrigerant is separated from the lubrication oil.

According to the fourth aspect of the invention, the pressure reduction groove (65) is formed so as to overlap with the elastic bearing (62) as viewed in the plane. Thus, catching of the upper end of the elastic bearing (62) by the thrust bearing surface (26*a*) of the eccentric part (26) due to deformation of the elastic bearing (62) can be reduced or prevented. Consequently, damage of the thrust bearing surface (26*a*) can be reduced or prevented. Moreover, the pressure reduction groove (65) is formed at the inner circumferential end part of the thrust bearing surface (26*a*). Thus, lubrication oil flowing out from the pressure reduction groove (65) extends across the entirety of the thrust bearing surface (26*a*). As a result, the entirety of the thrust bearing surface (26*a*) can be cooled with the lubrication oil.

According to the fifth aspect of the invention, the pressure reduction groove (65) is formed so as to have the diameter smaller than that of the groove (61) forming the elastic bearing (62). Thus, a decrease in area of the thrust bearing surface (26*a*) due to the pressure reduction groove (65) opening at the thrust bearing surface (26*a*) can be reduced to the minimum possible.

According to the sixth aspect of the invention, gas refrigerant separated from lubrication oil in the pressure reduction groove (65) can be discharged. Thus, even if the rotary compressor is operated at a high rotational speed for a long period of time, only the lubrication oil from Which the gas refrigerant is separated can be supplied between the sliding surfaces of the thrust bearing. Thus, it can be ensured that the thrust bearing surface (26*a*) of the eccentric part (26) and the upper end surface (35*b*) of the lower end plate (35) which define the sliding surfaces of the thrust bearing are cooled.

According to the seventh aspect of the invention, the pressure reduction groove (65) is formed such that the side oil supply groove (72) is formed at the side surface of the eccentric part (26) and opens to the pressure reduction groove (65) on the lower side of the side oil supply groove (72). Thus, the corner part formed on the lower side of the side oil supply groove (72) can be prevented from shaving off the upper end surface (35*b*) of the lower end plate (35) slidably contacting the thrust bearing surface (26*a*).

DESCRIPTION OF EMBODIMENTS

Embodiments of the present disclosure will be described below in detail with reference to drawings.

<<First Embodiment of the Invention>>

Figure 1:
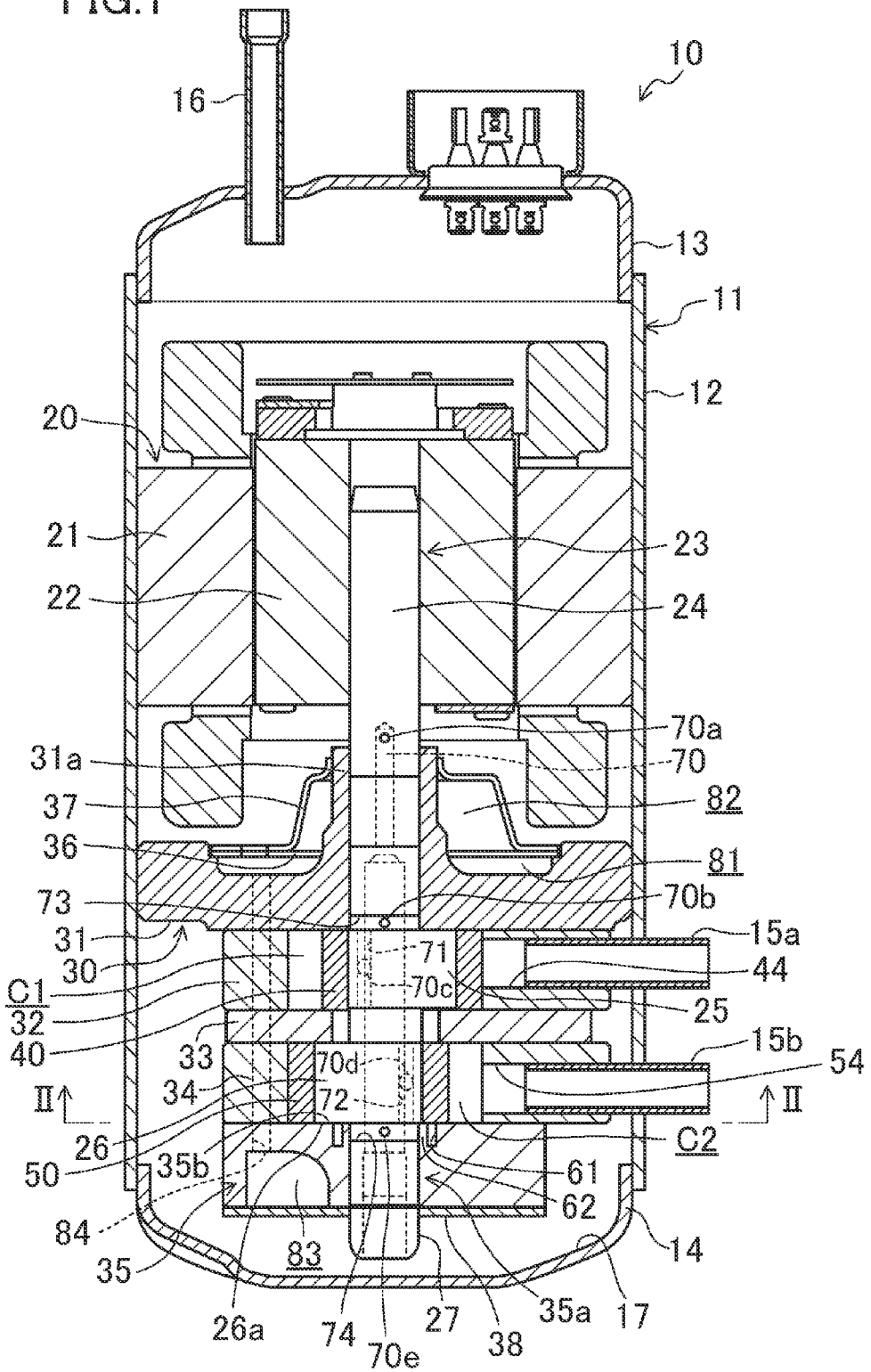
FIG. 1 is a longitudinal sectional view of a compressor of a first embodiment of the present disclosure.

A rotary compressor (10) of a first embodiment of the present disclosure is provided in, e.g., a refrigerant circuit of an air conditioning apparatus, and is configured to compress refrigerant sucked from an evaporator to discharge the compressed refrigerant to a radiator. Referring to FIG. 1, the rotary compressor (10) includes a casing (an electric motor (20), and a compression mechanism (30).

The casing (11) includes a cylindrical body (12), an upper end plate (13) closing the body (12) at an upper end thereof, and a lower end plate (14) closing the body (12) at a lower end thereof. A first suction pipe (15*a*) and a second suction pipe (15*b*) are attached to the body (12) so as to penetrate a lower part of the body (12). Moreover, a discharge pipe (16) is attached to an upper part of the upper end plate (13) so as to penetrate the upper end plate (13). In the casing (11), the electric motor (20) and the compression mechanism (30) are housed. An oil sump (17) configured to store lubrication oil for lubricating a sliding part of the compression mechanism (30) is formed in a bottom part of the lower end plate (14).

The electric motor (20) includes a cylindrical stator (21), a cylindrical rotor (22), and a drive shaft (23). The stator (21) is fixed to the body (12) of the casing (11). The rotor (22) is disposed in a hollow part of the stator (21). In a hollow part of the rotor (22), the drive shaft (23) is fixed so as to penetrate the rotor (22).

The drive shaft (23) includes a vertically-extending main shaft part (24) and two eccentric parts (25, 26) integrally formed with the main shaft part (24) in a lower end part thereof. The two eccentric parts (25, 26) include an upper eccentric part (25) formed on an upper side and a lower eccentric part (26) formed below the upper eccentric part (25). Any of the upper eccentric part (25) and the lower eccentric part (26) is formed so as to have a diameter larger than that of the main shaft part (24). The upper eccentric part (25) and the lower eccentric part (26) are each formed such that the shaft center thereof is eccentric relative to the shaft center of the main shaft part (24) by a predetermined distance. In the first embodiment, the direction of eccentricity of the upper eccentric part (25) relative to the main shaft part (24) and the direction of eccentricity of the lower eccentric part (26) relative to the main shaft part (24) are displaced from each other by 180 degrees. A lower end surface of the lower eccentric part (26) defines a thrust bearing surface (26*a*) slidably contacting an upper end surface (35*b*) of a rear head (35) which will be described later.

Referring to FIG. 1, a centrifugal pump (27) extending to the inside of the oil sump (17) is provided at a lower end of the drive shaft (23). An oil supply path (oil path) (70) through which lubrication oil drawn by the centrifugal pump (27) flows is formed inside the drive shaft (23) so as to extend in an axial direction of the drive shaft (23). First to fifth paths (70*a*-70*e*) are connected to the oil supply path (70). Each of the first to fifth paths (70*a*-70*e*) extends in a radial direction of the drive shaft (23), and each outlet end of the first to fifth paths (70*a*-70*e*) opens at an outer circumferential surface of the drive shaft (23). The first path (70*a*) is a gas discharge path through which bubbles of refrigerant gas in the oil supply path (70) are discharged, and the second to fifth paths (70*b*-70*e*) are each an oil discharge path through which lubrication oil drawn to the oil supply path (70) is discharged.

Specifically, the first path (70*a*) is formed at part of the drive shaft (23) in the vicinity of an upper end part of the compression mechanism (30). The second path (70*b*) is formed at part of the drive shaft (23) in the vicinity of an upper part of the upper eccentric part (25), and the third path (70*c*) is formed inside the upper eccentric part (25). The fourth path (70*d*) is formed inside the lower eccentric part (26), and the fifth path (70*e*) is formed at part of the drive shaft (23) in the vicinity of a lower part of the lower eccentric part (26). The third path (70*c*) formed in the upper eccentric part (25) extends in such a direction that the phase thereof is shifted relative to the eccentric direction of the upper eccentric part (25) by 120°, and the fourth path (70*d*) formed in the lower eccentric part (26) extends in such a direction that the phase thereof is shifted relative to the eccentric direction of the lower eccentric part (26) by 120°. Moreover, the third path (70*c*) and the fourth path (70*d*) extend in such a direction that the phases thereof are shifted from each other by 180°.

First and second vertical grooves (71, 72) are formed at the outer circumferential surface of the drive shaft (23). The first vertical groove (71) extends in the axial direction at the outer circumferential surface of the upper eccentric part (25) of the drive shaft (23), and the outlet end of the third path (70*c*) opens to the first vertical groove (71). The first vertical groove (71) guides lubrication oil on an upper end surface of the upper eccentric part (25) to a space between a lower end surface of the upper eccentric part (25) and an upper end surface of a middle plate (33) which will be described later. The second vertical groove (72) extends in the axial direction at the outer circumferential surface of the lower eccentric part (26) of the drive shaft (23), and the outlet end of the fourth path (70*d*) opens to the second vertical groove (72). The second vertical groove (72) guides lubrication oil on an upper end surface of the lower eccentric part (26) to a space between the lower end surface of the lower eccentric part (26) and the upper end surface (35*b*) of the rear head (35) which will be described later.

Moreover, first and second annular grooves (73, 74) are formed at the outer circumferential surface of the drive shaft (23). The first annular groove (73) extends in a circumferential direction of the drive shaft (23) at part of the outer circumferential surface of the drive shaft (23) in the vicinity of the upper part of the upper eccentric part (25), and the outlet end of the second path (70*b*) opens to the first annular groove (73). The first annular groove (73) guides, in the circumferential direction, lubrication oil flowing out from the second path (70*b*), and causes the lubrication oil to flow between the upper end surface of the upper eccentric part (25) and a lower end surface of a front head (31) which will be described later. The second annular groove (74) serves as an oil groove of the present disclosure. The second annular groove (74) extends in the circumferential direction at part of the outer circumferential surface of the drive shaft (23) in the vicinity of the lower part of the lower eccentric part (26), and the outlet end of the fifth path (70*e*) opens to the second annular groove (74). The second annular groove (74) guides, in the circumferential direction, lubrication oil flowing out from the fifth path (70*e*), as well as supplying the lubrication oil to a pressure reduction groove (65) (see FIG. 4) which will be described later.

According to the foregoing configuration, lubrication oil of the oil sump (17) is, with rotation of the drive shaft (23), drawn up to the oil supply path (70) by the centrifugal pump (27). The lubrication oil drawn up to the oil supply path (70) flows out from each of the second to fifth paths (70*b*-70*e*), and flows to the sliding part of the compression mechanism (30) through the first and second vertical grooves (71, 72) and the first and second annular grooves (73, 74) to lubricate and cool the sliding part.

The compression mechanism (30) includes the annular front head (31), an annular upper cylinder (32), the annular middle plate (33), an annular lower cylinder (34), and the annular rear head (lower end plate) (35). These annular members (31-35) are stacked on each other in this order from the upper side to the lower side, and are fastened together with a plurality of bolts each extending in the axial direction. The drive shaft (23) vertically penetrates the annular members (31-35).

Each of the upper cylinder (32) and the lower cylinder (34) is a thick cylindrical member. On the other hand, each of the front head (31), the middle plate (33), and the rear head (35) is a thick discoid member. A hole through which the drive shaft (23) penetrates is formed at the center of each annular member (31-35). Each inner circumferential edge part of the front head (31) and the rear head (35) forming the hole serves as a plain bearing part (31*a*, 35*a*) configured to rotatably support the main shaft part (24) of the drive shaft (23). In the first embodiment, the front head (31) serves as a main bearing, and the rear head (35) serves as a sub-bearing.

Figure 2:
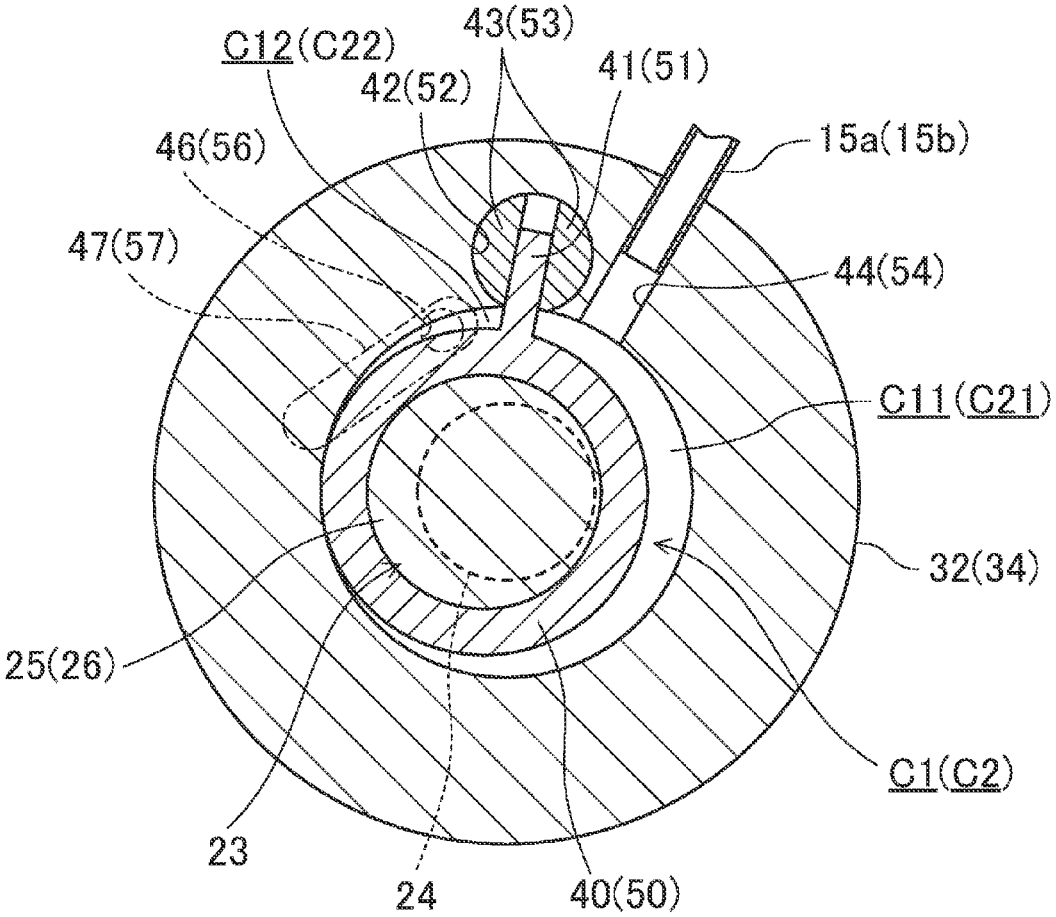
FIG. 2 is a cross-sectional view of a compression mechanism of the compressor illustrated in FIG. 1.

The upper cylinder (32) is, at an upper end thereof, closed by the front head (31), and is, at a lower end thereof, closed by the middle plate (33). A closed space inside the upper cylinder (32) serves as an upper cylinder chamber (C1). In the upper cylinder chamber (C1), an upper piston (40) slidably fitted onto the upper eccentric part (25) of the drive shaft (23) is housed. Referring to FIG. 2, an upper blade (41) extending from an outer circumferential surface of the upper piston (40) toward the outside in the radial direction is integrally formed with the upper piston (40). The upper cylinder chamber (C1) is, by the upper blade (41), divided into a low-pressure chamber (C11) communicating with the first suction pipe (15*a*) and a high-pressure chamber (C12) to which a later-described upper discharge port (46) opens.

FIG. 2 is a cross-sectional view of part of the compression mechanism (30) in the vicinity of the upper cylinder chamber (C1). Since the configuration in a cross section of the compression mechanism (30) in the vicinity of a lower cylinder chamber (C2) is similar to the configuration in the cross section of the compression mechanism (30) in the vicinity of the upper cylinder chamber (C1), a reference numeral for each component in the lower cylinder chamber (C2) is in parentheses, and such components are not shown in the figure, Referring to FIG. 1, the lower cylinder (34) is, at an upper end thereof, closed by the middle plate (33), and is, at a lower end thereof, closed by the rear head (35). A closed space inside the lower cylinder (34) serves as the lower cylinder chamber (C2). In the lower cylinder chamber (C2), a lower piston (50) slidably fitted onto the lower eccentric part (26) of the drive shaft (23) is housed. Referring to FIG. 2, a lower blade (51) extending from an outer circumferential surface of the lower piston (50) toward the outside in the radial direction is integrally formed with the lower piston (50). The lower cylinder chamber (C2) is, by the lower blade (51), divided into a low-pressure chamber (C21) communicating with the second suction pipe (15*b*) and a high-pressure chamber (C22) to which a later-described lower discharge port (56) opens.

Referring to FIG. 2, a circular groove is formed in the upper cylinder (32) as viewed in the plane. The circular groove serves as a bush groove (42) in which a pair of bushes (43) are housed. The bushes (43) formed in a semilunar shape as viewed in the plane are fitted into the bush groove (42) so as to sandwich the upper blade (41). As in the upper cylinder (32), a groove formed in a circular shape as viewed in the plane is formed in the lower cylinder (34). The circular groove serves as a bush groove (52) in which a pair of bushes (53) are housed. The bushes (53) formed in a semilunar shape as viewed in the plane are fitted into the bush groove (52) so as to sandwich the lower blade (51).

A suction through-path (44) penetrating between an inner circumferential surface and the outer circumferential surface of the upper cylinder (32) in the radial direction is formed in the upper cylinder (32). An end part of the first suction pipe (15*a*) is inserted into the suction through-path (44) (see FIG. 1). On the other hand, a suction through-path (54) penetrating between an inner circumferential surface and an outer circumferential surface of the lower cylinder (34) in the radial direction is formed in the lower cylinder (34). An end part of the second suction pipe (15*b*) is inserted into the suction through-path (54).

Referring to FIG. 1, a recess opening upward is formed at an upper surface of the front head (31), and is covered by an inner cover (36). Moreover, an upper surface of the inner cover (36) is covered by an outer cover (37). An inner discharge space (81) is formed between the upper surface of the front head (31) at which the recess is formed and the inner cover (36), and an outer discharge space (82) is formed between the inner cover (36) and the outer cover (37).

The upper discharge port (46) vertically penetrating the front head (31) and causing the inner discharge space (81) and the high-pressure chamber (C12) of the upper cylinder chamber (C1) to communicate with each other is formed in the front head (31). Moreover, a discharge valve (47) configured to open/close the upper discharge port (46) is attached to the front head (31). The discharge valve (47) is opened/closed to cause the upper discharge port (46) to intermittently communicate with the high-pressure chamber (C12) formed inside the upper cylinder (32). Further, a through-hole (not shown in the figure) through which the inner discharge space (81) and the outer discharge space (82) communicate with each other is formed in the inner cover (36). A through-hole (not shown in the figure) through which the outer discharge space (82) and an internal space of the casing (11) communicate with each other is formed in the outer cover (37).

A recess extending in the circumferential direction and opening downward is formed at a lower surface of the rear head (35). The recess is covered by a closing plate (38), and a closed space is formed inside the rear head (35). The closed space serves as a lower discharge space (83). The lower discharge space (83) communicates with the inner discharge space (81) formed between the front head (31) and the inner cover (36) through a refrigerant through-hole (84) penetrating the rear head (35), the lower cylinder (34), the middle plate (33), the upper cylinder (32), and the front head (31).

The lower discharge port (56) vertically penetrating the rear head (35) and causing the lower discharge space (83) and the high-pressure chamber (C22) of the lower cylinder chamber (C2) to communicate with each other is formed in the rear head (35). Moreover, a discharge valve (57) configured to open/close the lower discharge port (56) is attached to the rear head (35). The discharge valve (57) is opened/closed to cause the lower discharge port (56) to intermittently communicate with the high-pressure chamber (C22) formed inside the lower cylinder (34).

Figure 3:
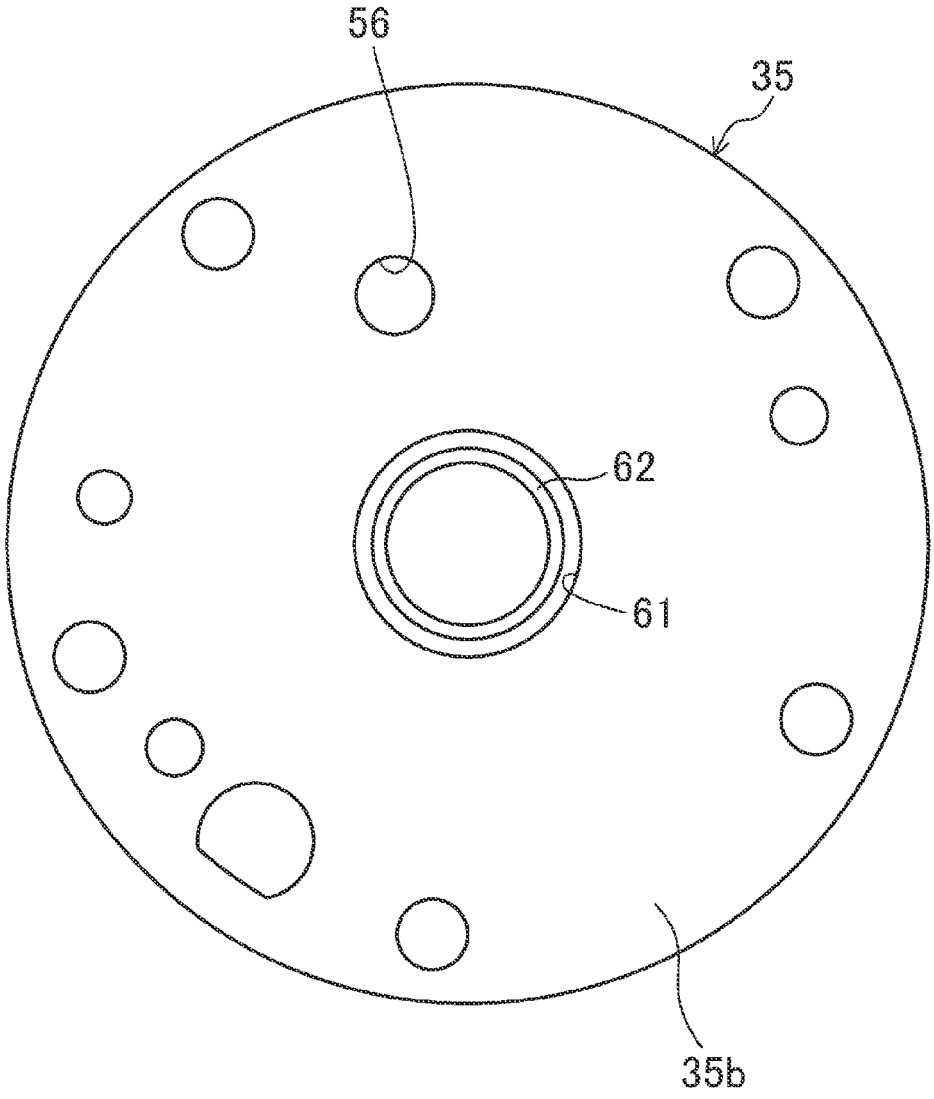
FIG. 3 is a plan view of a rear head of the compressor illustrated in FIG. 1.

As described above, the inner circumferential edge part forming the hole of the rear head (35) serves as the plain bearing part (35*a*) configured to rotatably support the lower end part of the main shaft part (24) of the drive shaft (23). Referring to FIG. 3, a groove (61) formed in an annular shape as viewed in the plane is formed at the center of the upper end surface (35*b*) of the rear head (35). Since the annular groove (61) is formed at the upper end. surface (35*b*) of the rear head (35), part of the rear head (35) above the plain bearing part (35*a*) and inside relative to the groove (61) serves as an elastic bearing (62) configured to elastically support the drive shaft (23). That is, when a load is applied to the lower end part of the main shaft part (24) of the drive shaft (23) in a direction toward the groove (61), the elastic bearing (62) warps and enters the groove (61), and therefore the drive shaft (23) is elastically supported.

Figure 4:
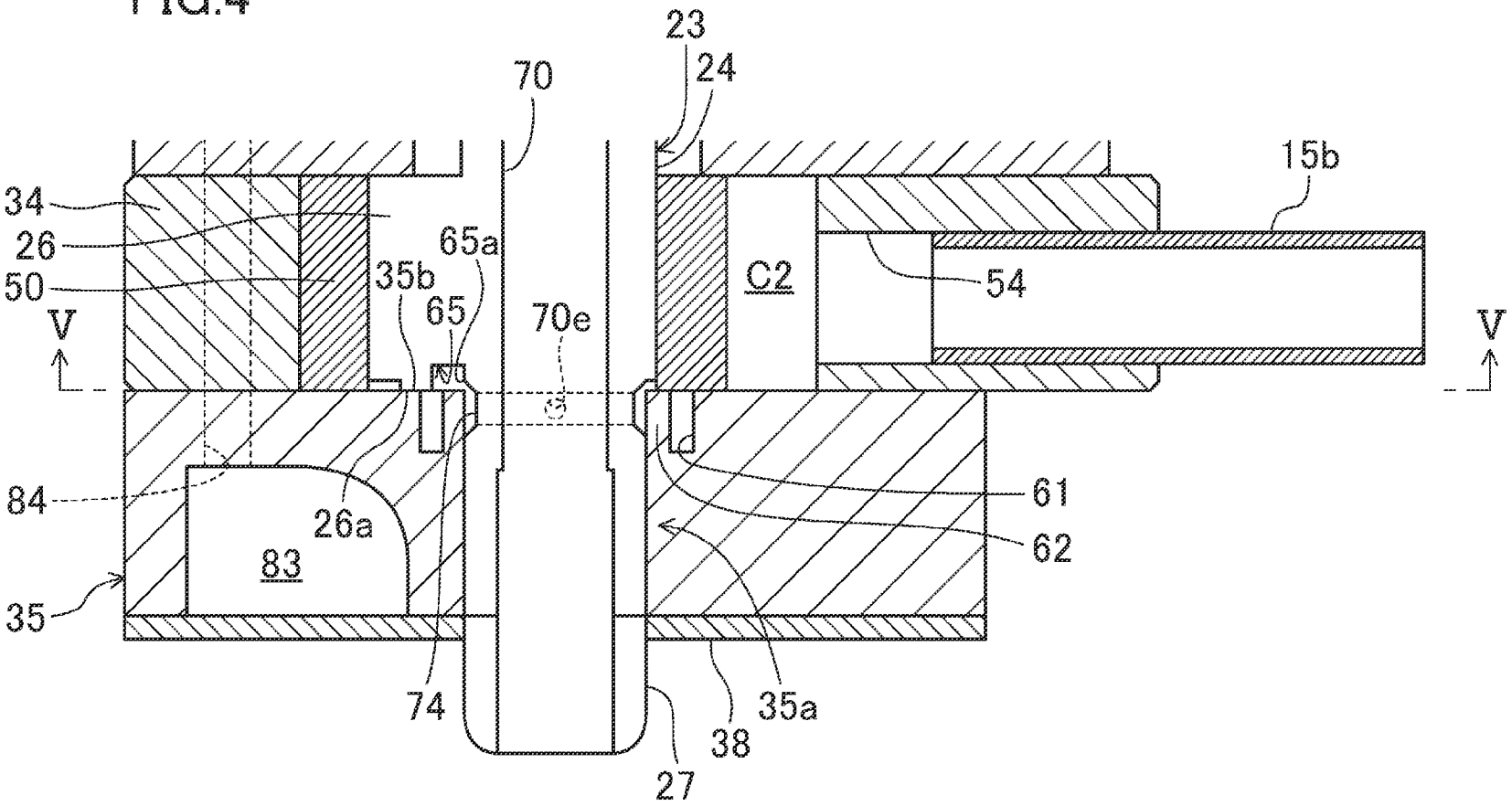
FIG. 4 is an enlarged partial view of the compressor illustrated in FIG. 1.

As will be seen from an enlarged view of FIG. 4, the lower end surface of the lower eccentric part (26) defines the thrust bearing surface (26*a*) slidably contacting the upper end surface (35*b*) of the rear head (35). The thrust bearing surface (26*a*) is defined by an end surface of a protrusion protruding downward relative to part of the lower end surface of the lower eccentric part (26) other than the thrust bearing surface (26*a*). In the rotary compressor (10), the thrust bearing surface (26*a*) of the lower eccentric part (26) and the upper end surface (35*b*) of the rear head (35) define sliding surfaces of a thrust bearing configured to support a thrust load.

The pressure reduction groove (65) opening at the thrust bearing surface (26*a*) on a lower side of the pressure reduction groove (65) and which extends in the circumferential direction is formed in the lower eccentric part (26). The pressure reduction groove (65) is formed so as to surround the main shaft part (24) of the drive shaft (23).

Figure 5:
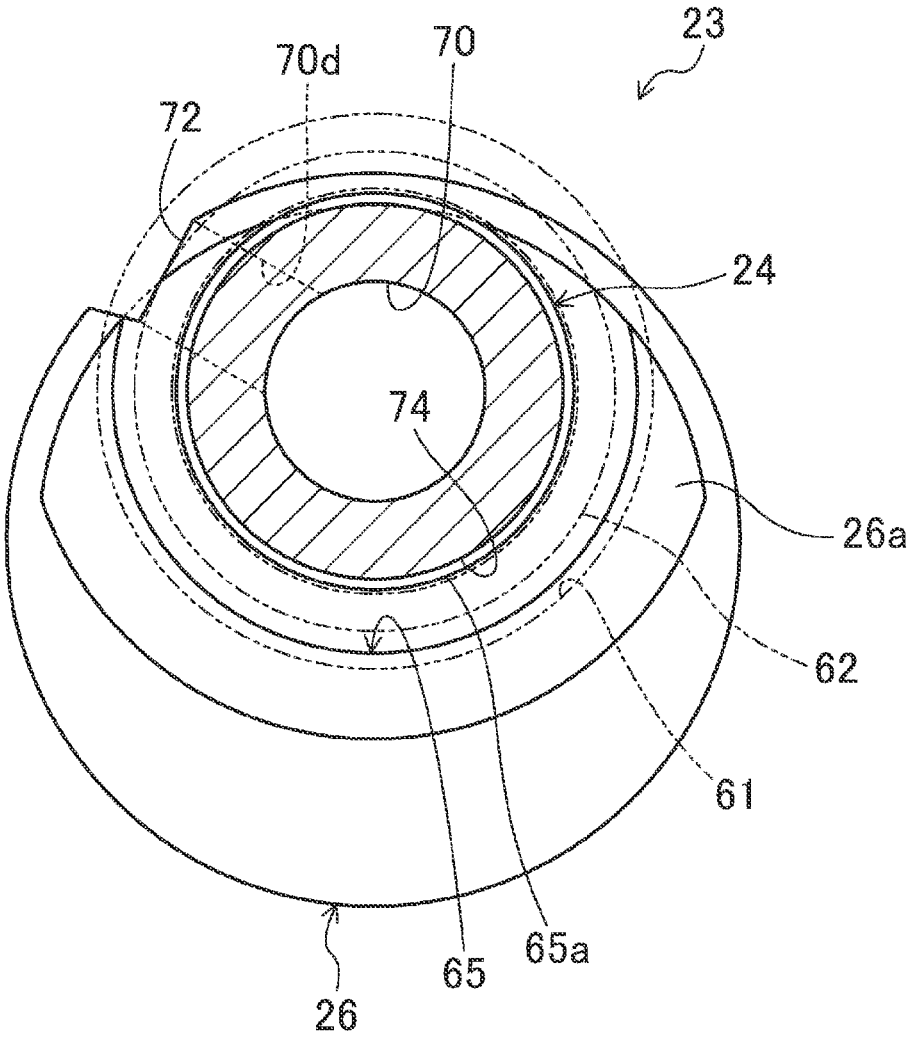
FIG. 5 is a cross-sectional view along a V-V line illustrated in FIG. 4.

In the first embodiment, the pressure reduction groove (65) communicates, referring to FIG. 5, with the second annular groove (74) formed between the rear head (35) and the drive shaft (23) through a communication part (65*a*). The pressure reduction groove (65) and the second annular groove (74) are configured such that the communication part (65*a*) serves as a throttle configured to reduce the pressure of lubrication oil supplied from the second annular groove (74) to the pressure reduction groove (65). Specifically, the pressure reduction groove (65) and the second annular groove (74) communicate with each other on the lower side of the pressure reduction groove (65) and an upper side of the second annular groove (74), and the cross-sectional area of the communication part (65*a*) is smaller than the cross-sectional area the area of an inner surface of the pressure reduction groove (65)) of the pressure reduction groove (65). Since the pressure reduction groove (65) and the second annular groove (74) are formed as just described, the pressure of lubrication oil supplied to the second annular groove (74) sharply decreases after the lubrication oil flows into the pressure reduction groove (65) through the communication part (65*a*).

In the first embodiment, the pressure reduction groove (65) is formed so as to overlap with the elastic bearing (62) as viewed in the plane. Specifically, the pressure reduction groove (65) is formed such that an outer circumferential edge thereof is positioned on the outer circumferential side relative to an outer circumferential edge (i.e., an inner circumferential edge of the groove (61)) of the elastic bearing (62) and that an inner circumferential edge thereof is positioned at the same position as an inner circumferential edge (i.e., an inner circumferential edge of the rear head (35)) of the elastic bearing (62). Note that the pressure reduction groove (65) may be firmed such that the inner circumferential edge thereof is positioned slightly on the inner circumferential side relative to the inner circumferential edge (i.e., the inner circumferential edge of the rear head (35)) of the elastic bearing (62).

Moreover, the pressure reduction groove (65) is formed such that the outer circumferential edge thereof is positioned on the inner circumferential side relative to an outer circumferential edge of the groove (61). That is, the pressure reduction groove (65) is formed on the inner circumferential side relative to the groove (61), and is formed so as to have a diameter smaller than that of the groove (61).

Further, the pressure reduction groove (65) is formed such that the second vertical groove (72) formed at the outer circumferential surface of the lower eccentric part (26) opens to the pressure reduction groove (65) on a lower side of the second vertical groove (72). Note that the second vertical groove (72) opens to the pressure reduction groove (65) on the lower side of the second vertical groove (72), and such an opening of the second vertical groove (72) is formed so as not to overlap with part of the thrust bearing surface (26*a*) other than part where the pressure reduction groove (65) opens. Since the pressure reduction groove (65) and the second vertical groove (72) are formed as just described, a corner part formed between a wall surface forming the second vertical groove (72) and a wall surface forming an upper edge of the pressure reduction groove (65) does not contact the upper end surface (35*b*) of the rear head (35).

Operation

In the rotary compressor (10), the electric motor (20) is started to eccentrically rotate, with rotation of the drive shaft (23), the piston (40, 50) fitted onto the eccentric part (25, 26) in the cylinder chamber (C1, C2). The volume of the low-pressure chamber (C11, C21) of the cylinder chamber (C1, C2) and the volume of the high-pressure chamber (C12, (C22) of the cylinder chamber (C1, C2) periodically changes accordingly, and suction, compression, and discharge of refrigerant are successively performed in the high-pressure chamber (C12, C22).

Refrigerant sucked into the low-pressure chamber (C11, C21) of the cylinder chamber (C1, C2) through the suction pipe (15*a*, 15*b*) is compressed in the high-pressure chamber (C12, C22) of the cylinder chamber (C1, C2), and then is discharged through the discharge port (46, 56). The refrigerant discharged through the upper discharge port (46) flows into the inner discharge space (81). On the other hand, the refrigerant discharged to the lower discharge space (83) through the lower discharge port (56) flows into the inner discharge space (81) through the refrigerant through-hole (84), and joins the refrigerant discharged from the upper cylinder chamber (C1) in the inner discharge space (81). The refrigerant discharged from the upper cylinder chamber (C1) and the lower cylinder chamber (C2) and joined together in the inner discharge space (81) flows into the outer discharge space (82) through the through-hole formed in the inner cover (36), and then flows into the internal space of the casing (11) through the through-hole formed in the outer cover (37). Then, the refrigerant flows out from the casing (11) through the discharge pipe (16).

In the rotary compressor (10), the lower end surface of the lower eccentric part (26) defines the thrust bearing surface (26*a*) slidably contacting the upper end surface (35*b*) of the rear head (35), and the thrust bearing surface (26*a*) and the upper end surface (35*b*) of the rear head (35) define the sliding surfaces of the thrust bearing. Moreover, in the rotary compressor (10), the internal pressure of the cylinder chamber (C1, C2) acts on the eccentric part (25, 26) of the drive shaft (23) through the piston (40, 50). Thus, there is a possibility that the drive shaft (23) greatly warps in, e.g., a high-load operation in which the internal pressure of the cylinder chamber (C1, C2) is relatively high. When the drive shaft (23) warps, so-called "corner scratching" occurs, i.e., a corner part formed between the upper end surface (35*b*) and an inner circumferential surface of the rear head (35) slidably contacts the thrust bearing surface (26*a*) of the lower eccentric part (26) of the drive shaft (23). Upon the corner scratching, the contact pressure between the thrust bearing surface (26*a*) of the lower eccentric part (26) and the upper end surface (35*b*) of the rear head (35) increases, and a sliding loss and abrasion at the thrust bearing increase. This results in lowering of an operation efficiency and reliability of the rotary compressor.

In the first embodiment, the annular groove (61) forming the elastic bearing (62) on an inner circumferential side thereof is, at the upper end surface (35*b*) of the rear head (35), formed at the periphery of the hole into which the drive shaft (23) is inserted, and the elastic bearing (62) elastically supports the drive shaft (23). Thus, the so-called corner scratching due to warpage of the drive shaft (23) is avoided, and an increase in contact pressure is reduced.

Cooling with Lubrication Oil

While the drive shaft (23) rotates, lubrication oil in the oil sump (17) is drawn to the oil supply path (70) of the drive shaft (23) by the centrifugal pump (27). The lubrication oil drawn to the oil supply path (70) upwardly flows, and then flows out from the second to fifth paths (70*b*-70*e*) to the outer circumferential surface of the drive shaft (23) by centrifugal force.

The lubrication oil flowing out from the second path (70*b*) is accumulated in the first annular groove (73). While the lubrication oil accumulated in the first annular groove (73) is guided to an upper end of the front head (31) along a spiral groove, not shown in the figure, formed at an inner circumferential surface of the plain bearing part (31*a*) of the front head (31), such lubrication oil lubricates and cools sliding surfaces between the plain bearing part (31*a*) of the front head (31) and the main shaft part (24) of the drive shaft (23). Moreover, the lubrication oil accumulated in the first annular groove (73) flows into a space between an upper end surface of the upper piston (40) and a lower end surface of the front head (31) slidably contacting the upper end surface of the upper piston (40), and then lubricates and cools the sliding surfaces.

The lubrication oil flowing out from the third path (70*c*) is accumulated in the first vertical groove (71). The lubrication oil accumulated in the first vertical groove (71) flows into a space between the outer circumferential surface of the upper eccentric part (25) of the drive shaft (23) and an inner circumferential surface of a plain bearing part of the upper piston (40) slidably contacting the outer circumferential surface of the upper eccentric part (25) of the drive shaft (23), and then lubricates and cools the sliding surfaces. Moreover, the lubrication oil accumulated in the first vertical groove (71) flows into the space between the upper end surface of the upper piston (40) and the lower end surface of the front head (31) slidably contacting the upper end surface of the upper piston (40) and into a space between the lower end surface of the upper piston (40) and the upper end surface of the middle plate (33) slidably contacting the lower end surface of the upper piston (40). Then, the lubrication oil lubricates and cools such sliding surfaces.

The lubrication oil flowing out from the fourth path (70*d*) is accumulated in the second vertical groove (72). The lubrication oil accumulated in the second vertical groove (72) flows into a space between the outer circumferential surface of the lower eccentric part (26) of the drive shaft (23) and an inner circumferential surface of a plain bearing part of the lower piston (50) slidably contacting the outer circumferential surface of the lower eccentric part (26) of the drive shaft (23), and then lubricates and cools the sliding surfaces. Moreover, the lubrication oil accumulated in the second vertical groove (72) flows into the following spaces: a space between an upper end surface of the lower piston (50) and a lower end surface of the middle plate (33) slidably contacting the upper end surface of the lower piston (50); a space between a lower end surface of the lower piston (50) and an upper end surface of the rear head (35) slidably contacting the lower end surface of the lower piston (50); and a space between the thrust bearing surface (26*a*) defined by the lower end surface of the lower eccentric part (26) of the drive shaft (23), and the upper end surface (35*b*) of the rear head (35) slidably contacting the thrust bearing surface (26*a*). Then, the lubrication oil lubricates and cools such sliding surfaces.

The lubrication oil flowing out from the fifth path (70*e*) is accumulated in the second annular groove (74). The lubrication oil accumulated in the second annular groove (74) flows into the following spaces: a space between an inner circumferential surface of the plain bearing part (35*a*) of the rear head (35) and an outer circumferential surface of the main shaft part (24) of the drive shaft (23) slidably contacting the inner circumferential surface of the plain bearing part (35*a*) of the rear head (35); a space between a lower end surface of the lower piston (50) and the upper end surface of the rear head (35) slidably contacting the lower end surface of the lower piston (50); and the space between the thrust bearing surface (26*a*) defined by the lower end surface of the lower eccentric part (26) of the drive shaft (23) and the upper end surface (35*b*) of the rear head (35) slidably contacting the thrust bearing surface (26*a*), i.e., the space between the sliding surfaces of the thrust bearing. Then, the lubrication oil lubricates and cools such sliding surfaces.

The lubrication oil in the second annular groove (74) flows into the pressure reduction groove (65) through the communication part (65*a*), and then flows into the space between the sliding surfaces of the thrust bearing. As described above, the cross-sectional area of the communication part (65*a*) is smaller than that of the pressure reduction groove (65). Thus, the pressure of the lubrication oil flowing into the pressure reduction groove (65) through the communication part (65*a*) sharply decreases. As a result, gas refrigerant dissolved in the lubrication oil is separated from the lubrication oil, and bubbles of the gas refrigerant are generated in the lubrication oil. Since the lubrication oil has a specific gravity greater than that of the gas refrigerant, centrifugal force acting on the lubrication oil is greater than that acting on the gas refrigerant. Thus, when the gas refrigerant is separated from the lubrication oil in the pressure reduction groove (65), the gas refrigerant is accumulated in an upper part of the pressure reduction groove (65) Meanwhile, the lubrication oil having the specific gravity greater than that of the gas refrigerant flows, upon receipt of great centrifugal force, from the pressure reduction groove (65) toward the outside in the radial direction, and then flows into the space between the thrust bearing surface (26*a*) defined by the lower end surface of the lower eccentric part (26) and the upper end surface (35*b*) of the rear head (35) slidably contacting the thrust bearing surface (26*a*). The lubrication oil supplied between the thrust bearing surface (26*a*) defined by the lower end surface of the lower eccentric part (26) and the upper end surface 35*b*) of the rear head (35) slidably contacting the thrust bearing surface (26*a*), i.e., the lubrication oil supplied between the sliding surfaces of the thrust bearing, flows toward the outside in the radial direction along the sliding surfaces. That is, only the lubrication oil from which the gas refrigerant is separated is supplied between the sliding surfaces of the thrust bearing. Thus, separation of the gas refrigerant from the lubrication oil receiving a thrust load and generation of bubbles of the gas refrigerant do not occur between the sliding surfaces of the thrust bearing. Consequently, the sliding surfaces of the thrust bearing are cooled with the lubrication oil from which the gas refrigerant is separated.

Advantages of First Embodiment

According to the first embodiment, part of lubrication oil flowing through the oil supply path (70) of the drive shaft (23) is supplied to the pressure reduction groove (65) opening at the thrust bearing surface (26*a*), and the pressure of such lubrication oil is reduced. As a result, gas refrigerant dissolved in the lubrication oil is separated in the pressure reduction groove (65). Thus, only the lubrication oil receiving centrifugal three greater than that acting on the gas refrigerant can flow from the pressure reduction groove (65) toward the outside in the radial direction, and can be supplied to the space between the thrust bearing surface (26*a*) defining one of the sliding surfaces of the thrust bearing and the upper end surface (35*b*) of the rear head (35) defining the other sliding surface of the thrust bearing. Since generation of gas refrigerant between the sliding surfaces of the thrust bearing can be reduced, the sliding surfaces of the thrust bearing can be effectively cooled with lubrication oil, and abrasive wear can be reduced.

According to the first embodiment, the second annular groove (74) through which lubrication oil of the oil supply path (70) is guided to the pressure reduction groove (65) communicates with the pressure reduction groove (65)

through the communication part (65*a*), and the communication part (65*a*) serves as the throttle configured to reduce the pressure of lubrication oil supplied from the second annular groove (74) to the pressure reduction groove (65). Thus, with a simple configuration, the pressure of lubrication oil in which gas refrigerant is dissolved can be sharply decreased in the pressure reduction groove (65), and it can be ensured that the gas refrigerant is separated from the lubrication oil.

In the rotary compressor (10), the internal pressure of the cylinder chamber (C1, C2) acts on the eccentric part (25, 26) of the drive shaft (23) through the piston (40, 50). Thus, there is a possibility that the drive shaft (23) greatly warps in, e.g., the high-load operation in which the internal pressure of the cylinder chamber (C1, C2) is relatively high. When the drive shaft (23) warps, the so-called corner scratching occurs, i.e., the corner part formed between the upper end surface and the inner circumferential surface of the rear head (35) slidably contacts the main shaft part (24) of the drive shaft (23). Upon the corner scratching, the contact pressure increases, and the sliding loss and the abrasion at the plain bearing part (35*a*) of the rear head (35) increase. This results in lowering of the operation efficiency and reliability of the rotary compressor. For such a reason, in the rotary compressor (10), the annular groove (61) forming the elastic bearing (62) on the inner circumferential side thereof is, at the upper end surface (35*b*) of the rear head (35), formed at the periphery of the hole into which the drive shaft (23) is inserted, and the elastic bearing (62) elastically supports the drive shaft (23). Thus, an crease in contact pressure due to the corner scratching is reduced. However, although the elastic bearing (62) warps to elastically support the drive shaft (23), there is a possibility that part of an upper end of the elastic bearing (62) is caught by the thrust bearing surface (26*a*) of the lower eccentric part (26) upon warpage of the elastic bearing (62) and the thrust bearing surface (26*a*) is damaged.

In the first embodiment, the pressure reduction groove (65) is formed so as to overlap with the elastic bearing (62) as viewed in the plane. Thus, even if the elastic bearing (62) is deformed, the upper end of the elastic bearing (62) enters the pressure reduction groove (65), and therefore is not caught by the thrust bearing surface (26*a*) of the lower eccentric part (26). Consequently, damage of the thrust bearing surface (26*a*) can be reduced or prevented. Moreover, the elastic bearing (62) is formed in an inner circumferential part of the rear head (35). Thus, since the pressure reduction groove (65) is formed so as to overlap with the elastic bearing (62) as viewed in the plane, the pressure reduction groove (65) is formed at an inner circumferential end part of the thrust bearing surface (26*a*). The pressure reduction groove (65) formed at the inner circumferential end part of the thrust bearing surface (26*a*) allows lubrication oil flowing out from the pressure reduction groove (65) to extend across the entirety of the thrust bearing surface (26*a*). Thus, the entirety of the thrust bearing surface (26*a*) can be cooled with the lubrication oil.

In the first embodiment, the pressure reduction groove (65) is firmed on the inner circumferential side relative to the outer circumferential edge of the groove (61). That is, the pressure reduction groove (65) is formed so as to have the diameter smaller than that of the groove (61) forming the elastic bearing (62). A larger diameter of the pressure reduction groove (65) opening at the thrust bearing surface (26*a*) results in a smaller area of the thrust bearing surface (26*a*). In the rotary compressor (10), the pressure reduction groove (65) is, as described above, formed so as to have the diameter smaller than that of the groove (61) forming the elastic bearing (62). Thus, a decrease in area of the thrust bearing surface (26*a*) due to the pressure reduction groove (65) opening at the thrust bearing surface (26*a*) can be reduced to the minimum possible.

In the rotary compressor (10), the second vertical groove (72) extending from an upper end to a lower end of the lower eccentric part (26) is formed at a side surface of the lower eccentric part (26). If the second vertical groove (72) opens at the thrust bearing surface (26*a*) on the lower side of the second vertical groove (72), a corner part is formed between the wall surface forming the second vertical groove (72) and the thrust bearing surface (26*a*), and there is a possibility that the corner part shaves off the upper end surface (35*b*) of the rear head (35) when the thrust bearing surface (26*a*) slides against the upper end surface (35*b*) of the rear head (35).

According to the first embodiment, the pressure reduction groove (65) is formed such that the second vertical groove (72) formed at the side surface of the lower eccentric part (26) opens to the pressure reduction groove (65) on the lower side of the second vertical groove (72). Thus, the corner part formed on the lower side of the second vertical groove (72) can be prevented from shaving off the upper end surface (35*b*) of the rear head (35) slidably contacting the thrust bearing surface (26*a*).

<<Second Embodiment of the Invention>>

In a rotary compressor (10) of a second embodiment, the groove (61) forming the elastic bearing (62) in the first embodiment is not formed. Moreover, a pressure reduction groove (65) and a second annular groove (74) do not directly communicate with each other, but indirectly communicate with each other through a clearance (65*b*) formed between a thrust bearing surface (26*a*) and an upper end surface (35*b*) of a rear head (35).

Figure 6:
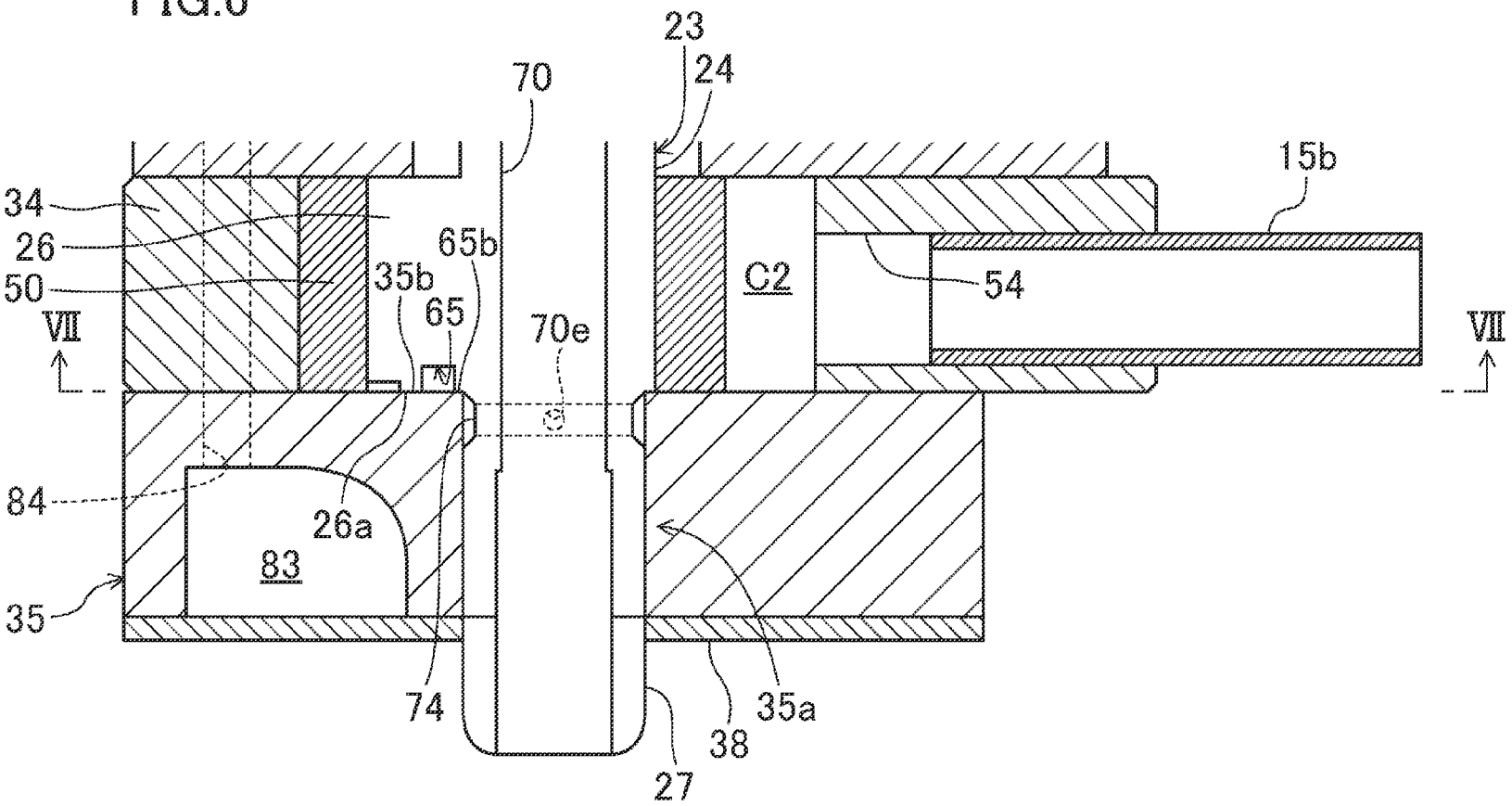
FIG. 6 is an enlarged partial view of a compressor of a second embodiment of the present disclosure.
Figure 7:
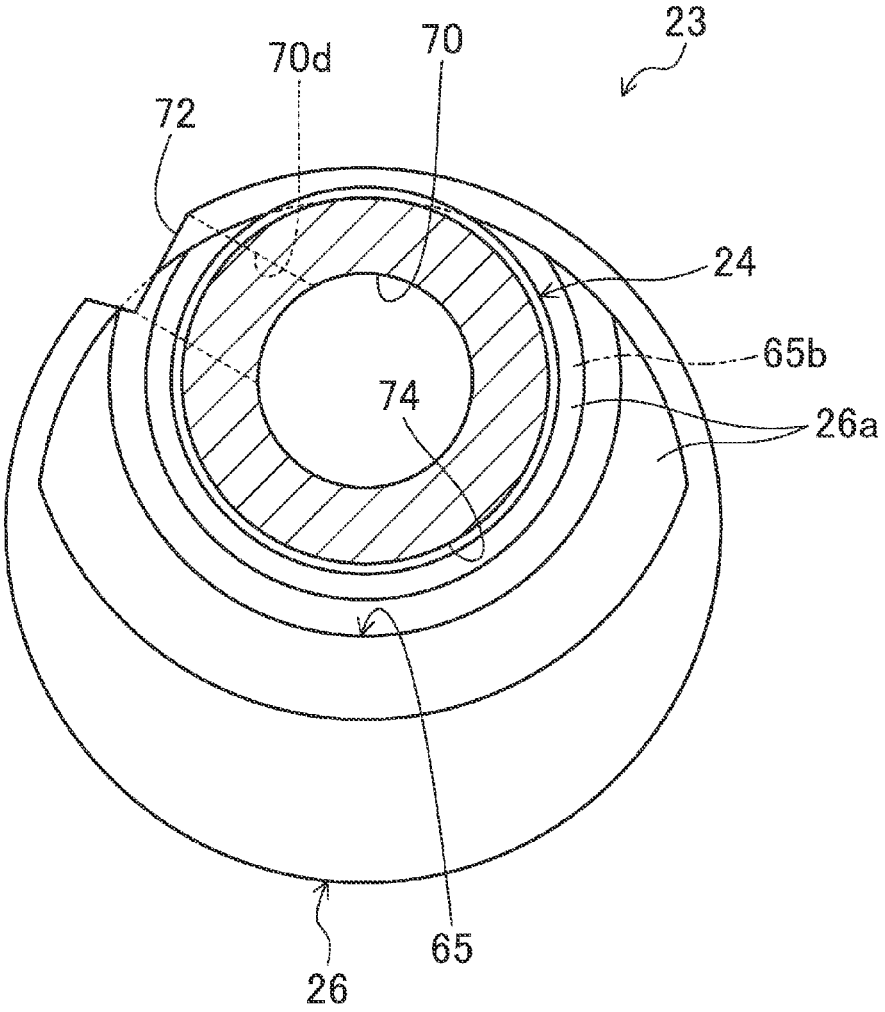
FIG. 7 is a cross-sectional view along a VII-VII line illustrated in FIG. 6.

Specifically, referring to FIGS. 6 and 7, the pressure reduction groove (65) is formed such that an inner circumferential edge thereof is positioned on the outer circumferential side relative to an inner circumferential edge of the thrust bearing surface (26*a*). In the second embodiment, since the pressure reduction groove (65) is formed at such a position, the pressure reduction groove (65) and the second annular groove (74) do not directly communicate with each other, but indirectly communicate with each other through the clearance (65*b*) formed between the thrust bearing surface (26*a*) and the upper end surface (35*b*) of the rear head (35).

As described above, since the thrust bearing surface (26*a*) and the upper end surface (35*b*) of the rear head (35) slidably contact each other, the clearance (65*b*) formed therebetween is a slight clearance. Thus, the pressure of lubrication oil supplied from the second annular groove (74) to the pressure reduction groove (65) sharply decreases in the clearance (65*b*) through which the pressure reduction groove (65) and the second annular groove (74) communicate with each other. That is, the pressure reduction groove (65) and the second annular groove (74) are configured such that the clearance (65*b*) formed between the thrust bearing surface (26*a*) and the upper end surface (35*b*) of the rear head (35) and allowing communication between the pressure reduction groove (65) and the second annular groove (74) serves as a throttle configured to reduce the pressure of lubrication oil. Other configurations are similar to those of the first embodiment.

According to the foregoing configuration, in the second embodiment, lubrication oil flowing from an oil supply path (70) to the second annular groove (74) through a fifth path (70*e*) receives centrifugal force, and then flows toward the outside in a radial direction. Subsequently, the lubrication oil is supplied to the pressure reduction groove (65) through the clearance (65*b*) formed between the thrust bearing surface (26*a*) and the upper end surface (35*b*) of the rear head (35). As described above, the clearance (65*b*) allowing communication between the second annular groove (74) and the pressure reduction groove (65) serves as the throttle configured to reduce the pressure of lubrication oil supplied from the second annular groove (74) to the pressure reduction groove (65). Thus, the pressure of the lubrication oil flowing into the pressure reduction groove (65) through the clearance (65*b*) formed between the thrust bearing surface (26*a*) and the upper end surface (35*b*) of the rear head (35) sharply decreases. As a result, gas refrigerant dissolved in the lubrication oil is separated from the lubrication oil, and then bubbles of the gas refrigerant are generated in the lubrication oil.

Since lubrication oil has a specific gravity greater than that of gas refrigerant, centrifugal force acting on the lubrication oil is greater than that acting on the gas refrigerant. Thus, when the gas refrigerant is separated from the lubrication oil in the pressure reduction groove (65), the gas refrigerant is accumulated in an upper part of the pressure reduction groove (65). Meanwhile, the lubrication oil having a specific gravity greater than that of the gas refrigerant receives great centrifugal force, and then flows from the pressure reduction groove (65) toward the outside in the radial direction. Subsequently, the lubrication oil flows into a space between the thrust bearing surface (26*a*) defined by a lower end surface of a lower eccentric part (26) and the upper end surface (35*b*) of the rear head (35) slidably contacting the thrust bearing surface (26*a*).

The lubrication oil supplied between the thrust bearing surface (26*a*) defined by the lower end surface of the lower eccentric part (26) of a drive shaft (23) and the upper end surface (35*b*) of the rear head (35) slidably contacting the thrust bearing surface (26*a*), i.e., the lubrication oil supplied between sliding surfaces of a thrust bearing, flows toward the outside in the radial direction along the sliding surfaces. That is, only the lubrication oil from which the gas refrigerant is separated is supplied between the sliding surfaces of the thrust bearing. Thus, separation of the gas refrigerant from the lubrication oil receiving a thrust load and generation of bubbles of the gas refrigerant do not occur between the sliding surfaces of the thrust bearing. Consequently, the sliding surfaces of the thrust bearing are cooled with the lubrication oil from which the gas refrigerant is separated.

As described above, advantages similar to those of the first embodiment can be also realized in the second embodiment.

<<Third Embodiment of the Invention>>

In a rotary compressor (10) of a third embodiment, the shape of the pressure reduction groove (65) of the first embodiment is changed.

Figure 8:
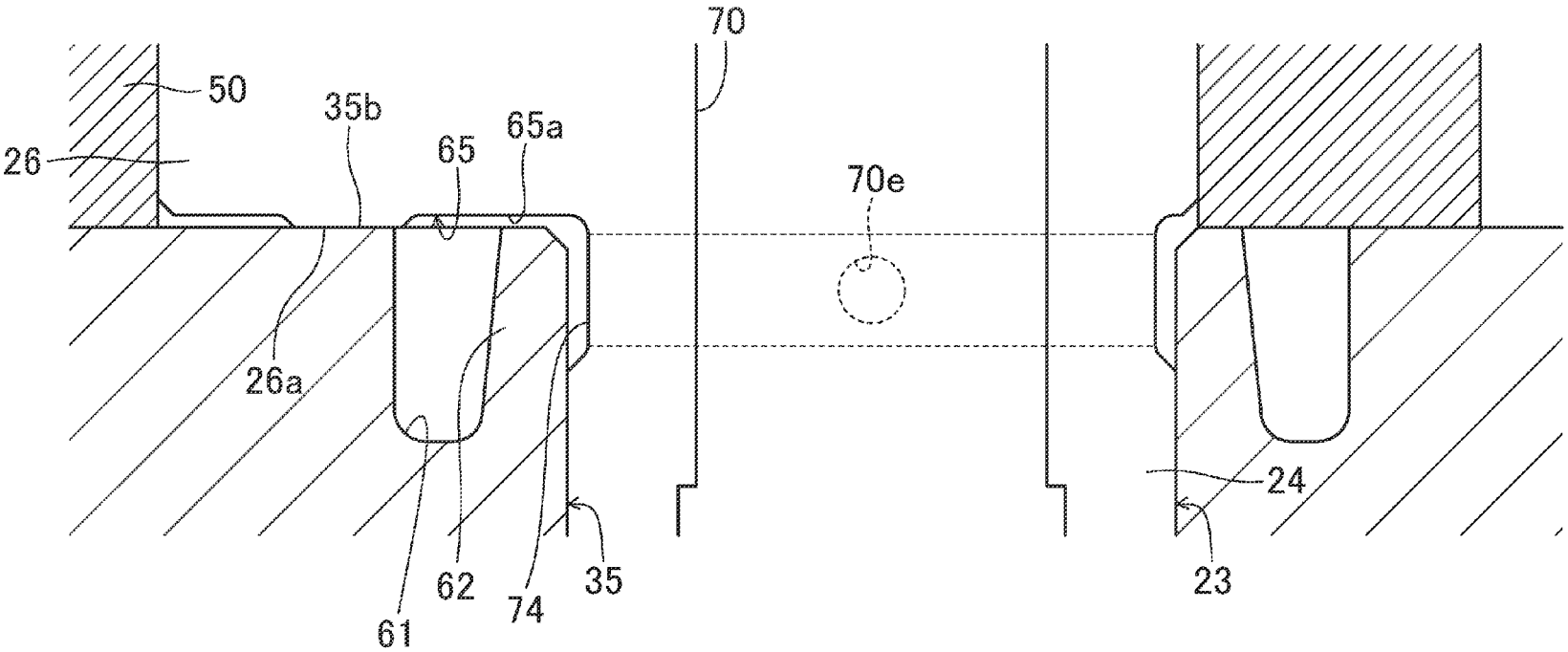
FIG. 8 is an enlarged partial view of a compressor of a third embodiment of the present disclosure.

Specifically, in the third embodiment, a pressure reduction groove (65) is, referring to FIG. 8, formed such that the length thereof in an axial direction is shorter than that of the pressure reduction groove (65) of the first embodiment (i.e., the depth thereof is less than that of the pressure reduction groove (65) of the first embodiment). Moreover, as in the first embodiment, the pressure reduction groove (65) is formed such that an outer circumferential edge thereof is positioned on the outer circumferential side relative to an outer circumferential edge of an elastic bearing (62) (i.e., an inner circumferential edge of a groove (61)) and that an inner circumferential edge thereof is at the same position as that of an inner circumferential edge of the elastic bearing (62) (i.e., an inner circumferential edge of a rear head (35)), Further, in the third embodiment, part of the pressure reduction groove (65) facing an upper end surface of the elastic bearing (62) is formed as a communication part (65*a*), and the pressure reduction groove (65) communicates with a second annular groove (74) through the communication part (65*a*).

In the third embodiment, the pressure reduction groove (65) is formed such that a depth is uniform across the communication part (65*a*) and an outer part formed on the outside of the communication part (65*a*) in a radial direction. However, the outer part of the pressure reduction groove (65) is formed so as to face the groove (61), and forms, together with the groove (61), a space larger than the communication part (65*a*). According to such a configuration, the pressure of lubrication oil flowing from the second annular groove (74) to the pressure reduction groove (65) through the communication part (65*a*) sharply decreases when the lubrication oil flows into the outer part through the communication part (65*a*). That is, in the third embodiment, the communication part (65*a*) serves as a throttle configured to reduce the pressure of lubrication oil supplied from the second annular groove (74) to the pressure reduction groove (65). Other configurations are similar to those of the first embodiment.

According to the foregoing configuration, in the third embodiment, lubrication oil flowing from an oil supply path (70) to the second annular groove (74) through a fifth path (70*e*) is supplied to the pressure reduction groove (65) through the communication part (65*a*).

As described above, the space formed by the outer part of the pressure reduction groove (65) and the groove (61) is formed larger than the communication part (65*a*) of the pressure reduction groove (65). In other words, the communication part (65*a*) of the pressure reduction groove (65) is formed smaller than the space formed by the outer part of the pressure reduction groove (65) and the groove (61), and serves as the throttle configured to reduce the pressure of lubrication oil supplied from the second annular groove (74) to the pressure reduction groove (65). Thus, the pressure of lubrication oil flowing into the pressure reduction groove (65) through the communication part (65*a*) sharply decreases when the lubrication oil flows from the communication part (65*a*) to the outer part. As a result, gas refrigerant dissolved in the lubrication oil is separated from the lubrication oil, and bubbles of the gas refrigerant are generated in the lubrication oil.

Since lubrication oil has a specific gravity greater than that of gas refrigerant, centrifugal force acting on the lubrication oil is greater than that acting on the gas refrigerant. Thus, when the gas refrigerant is separated from the lubrication oil in the pressure reduction groove (65), the gas refrigerant is accumulated in an upper part of the pressure reduction groove (65). Meanwhile, the lubrication oil having a specific gravity greater than that of the gas refrigerant receives great centrifugal force, and then flows from the pressure reduction groove (65) toward the outside in the radial direction. Subsequently, the lubrication oil flows into a space between a thrust bearing surface (26*a*) defined by a lower end surface of a lower eccentric part (26) and an upper end surface (35*b*) of a rear head (35) slidably contacting the thrust bearing surface (26*a*). The lubrication oil supplied between the thrust bearing surface (26*a*) defined by the lower end surface of the lower eccentric part (26) of a drive shaft (23) and the upper end surface (35*b*) of the rear head (35) slidably contacting the thrust bearing surface (26*a*), i.e., the lubrication oil supplied between sliding surfaces of a thrust bearing, flows toward the outside in the radial direction along the sliding surfaces. That is, only the lubrication oil from which the gas refrigerant is separated is supplied between the sliding surfaces of the thrust bearing. Thus, separation of the gas refrigerant from the lubrication oil receiving a thrust load and generation of bubbles of the gas refrigerant do not occur between the sliding surfaces of the thrust bearing. Consequently, the sliding surfaces of the thrust bearing are cooled with the lubrication oil from which the gas refrigerant is separated.

As described above, advantages similar to those of the first embodiment can be also realized in the third embodiment.

<<Fourth Embodiment of the Invention>>

Figure 9:
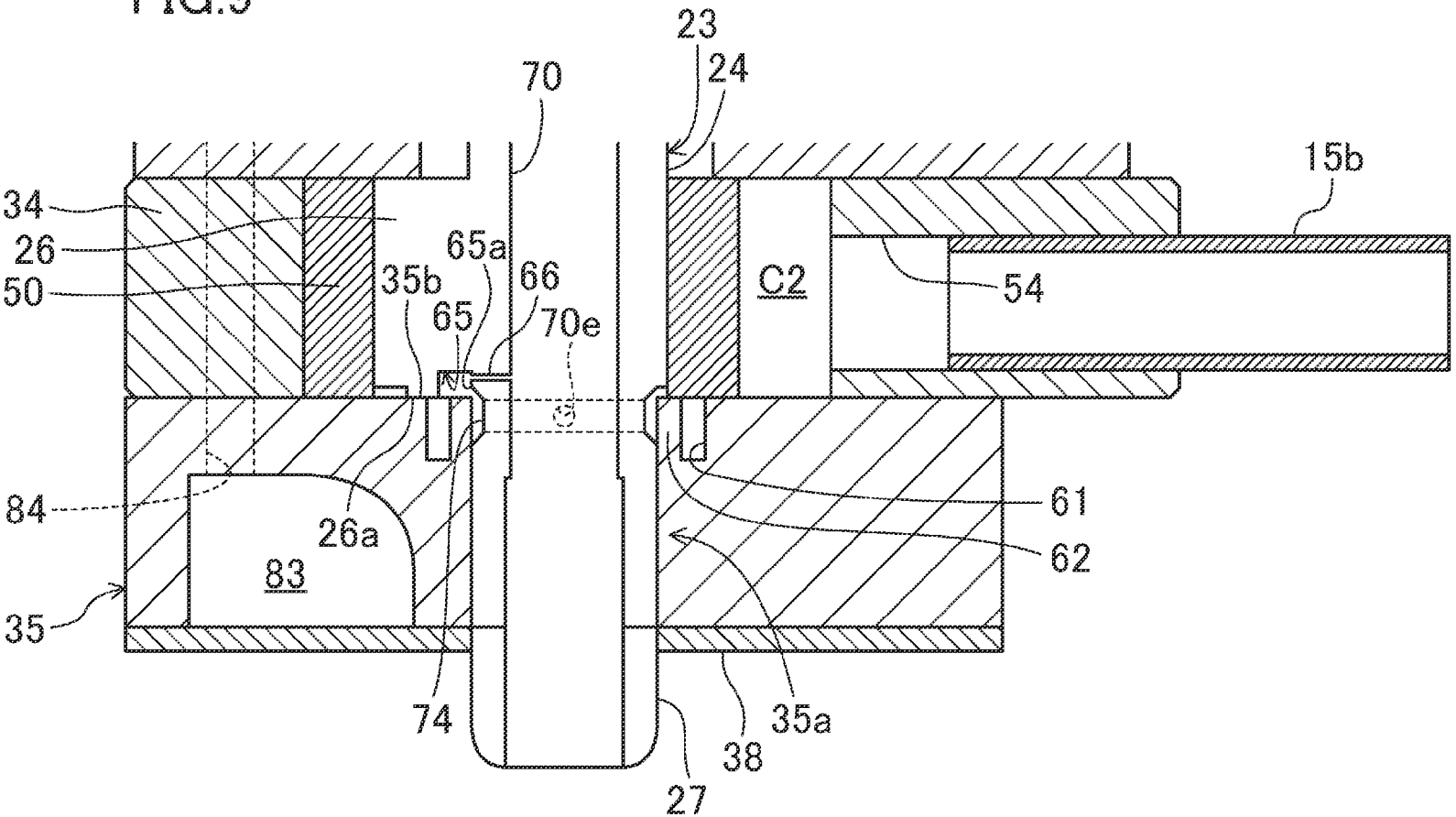
FIG. 9 is an enlarged partial view of a compressor of a fourth embodiment of the present disclosure.

A rotary compressor (10) of a fourth embodiment is configured such that a gas vent hole (66) through which gas refrigerant accumulated in an upper part of a pressure reduction groove (65) is guided to an oil supply path (70) is formed in the rotary compressor (10) of the first embodiment. Specifically, referring to FIG. 9, the gas vent hole (66) serves as a communication path through Which the upper part of the pressure reduction groove (65) and the oil supply path (70) communicate with each other. Since the gas vent hole (66) is formed as just described, gas refrigerant accumulated in the upper part of the pressure reduction groove (65) is discharged to the oil supply path (70) through the gas vent hole (66). Thus, even if the rotary compressor (10) is operated at a high rotational speed for a long period of time, only lubrication oil from which gas refrigerant is separated can be supplied between sliding surfaces of a thrust bearing. Thus, it can be ensured that a thrust bearing surface (26*a*) and an upper end surface (35*b*) of a rear head (35) defining the sliding surfaces of the thrust bearing are cooled.

<<Other Embodiments>>

In each of the foregoing embodiments, the rotary compressor (10) includes the so-called double-cylinder compression mechanism (30) having the two cylinder chambers (C1, C2). However, the compression mechanism of the rotary compressor of the present disclosure may be a so-called "single-cylinder compression mechanism" having only the lower cylinder chamber (C2). Specifically, the lower cylinder (34) may be, at the upper end thereof, closed by the front head (31), and may be, at the lower end thereof, closed by the rear head (35). A closed space in the lower cylinder 34) may serve as the lower cylinder chamber (C2). Even in the single-cylinder compression mechanism, advantages similar to those of each of the foregoing embodiments can be realized in such a manner that the pressure reduction groove (65) opening at the thrust bearing surface (26*a*) and extending in the circumferential direction is formed in the lower eccentric part (26) slidably contacting the upper end surface (35*b*) of the rear head (35).

Note that the foregoing embodiments have been set forth merely for the purpose of preferred examples in nature, and are not intended to limit the scope, applications, and use of the invention,

INDUSTRIAL APPLICABILITY

As described above, the present disclosure is useful for the rotary compressor.

What is claimed is:

1. A rotary compressor comprising:

a drive mechanism including a vertically-extending drive shaft formed with an eccentric part; and a compression mechanism including a tubular cylinder covering an outer periphery of the eccentric part, a piston arranged inside the cylinder and fitted onto the eccentric part, an upper end plate closing an upper end of the cylinder, and a lower end plate closing a lower end of the cylinder, a lower end surface of the eccentric part defining a thrust bearing surface slidably contacting an upper end surface of the lower end plate, the drive shaft having an oil path formed inside the drive shaft, lubrication oil circulating through the oil path, and the eccentric part having a pressure reduction groove formed therein, the pressure reduction groove opening at part of the thrust bearing surface close to an inner circumferential side, extending in a circumferential direction so as to surround the drive shaft, and being configured to reduce a pressure of the lubrication oil supplied from the oil path to the pressure reduction groove, at an upper end surface of the lower end plate, a groove extending in the circumferential direction and forming an elastic bearing on the inner circumferential side, the groove being formed at periphery of a hole into which the drive shaft is inserted, and the pressure reduction groove being formed so as to overlap with the elastic bearing as seen in a plan view.

2. The rotary compressor of claim 1, wherein an oil groove is formed between the lower end plate and the drive shaft, the oil groove extending in the circumferential direction, and the lubrication oil is supplied from the oil path to the oil groove, the pressure reduction groove communicates with the oil groove through a communication part, and the communication part serves as a throttle configured to reduce a pressure of the lubrication oil supplied from the oil groove to the pressure reduction groove.

3. The rotary compressor of claim 2, wherein the pressure reduction groove is formed such that an outer circumferential edge thereof is positioned on the inner circumferential side relative to an outer circumferential edge of the groove.

4. The rotary compressor of claim 3, wherein a communication path is formed in the eccentric part, and an upper part of the pressure reduction groove and the oil path communicate with each other through the communication path.

5. The rotary compressor of claim 2, wherein a communication path is formed in the eccentric part, and an upper part of the pressure reduction groove and the oil path communicate with each other through the communication path.

6. The rotary compressor of claim 2, wherein a side oil supply groove is formed at a side surface of the eccentric part, and the lubrication oil supplied from the oil path to an upper side of the eccentric part is guided to a lower side of the eccentric part through the side oil supply groove, and the pressure reduction groove is formed such that the side oil supply groove opens to the pressure reduction groove on a lower side of the side oil supply groove.

7. The rotary compressor of claim 1, wherein the pressure reduction groove is formed such that an outer circumferential edge thereof is positioned on the inner circumferential side relative to an outer circumferential edge of the groove.

8. The rotary compressor of claim 7, wherein a communication path is formed in the eccentric part, and an upper part of the pressure reduction groove and the oil path communicate with each other through the communication path.

9. The rotary compressor of claim 7, wherein a side oil supply groove is formed at a side surface of the eccentric part, and the lubrication oil supplied from the oil path to an upper side of the eccentric part is guided to a lower side of the eccentric part through the side oil supply groove, and the pressure reduction groove is formed such that the side oil supply groove opens to the pressure reduction groove on a lower side of the side oil supply groove.

10. The rotary compressor of claim 1, wherein a communication path is formed in the eccentric part, and an upper part of the pressure reduction groove and the oil path communicate with each other through the communication path.

11. The rotary compressor of claim 1, wherein a side oil supply groove is formed at a side surface of the eccentric part, and the lubrication oil supplied from the oil path to an upper side of the eccentric part is guided to a lower side of the eccentric part through the side oil supply groove, and the pressure reduction groove is formed such that the side oil supply groove opens to the pressure reduction groove on a lower side of the side oil supply groove.

* * * * *